United States Patent [19]

Doll et al.

[11] 4,158,255

[45] Jun. 19, 1979

[54] CABLE NET COOLING TOWER JACKET INSTALLATION METHOD

[75] Inventors: Michael Doll, Erfelden; Anton Heseding, Goddelau; Erich Jasch, Leeheim, all of Fed. Rep. of Germany

[73] Assignee: Fried. Krupp Gesellschaft mit beschränkter Haftung, Essen, Fed. Rep. of Germany

[21] Appl. No.: 793,491

[22] Filed: May 4, 1977

[30] Foreign Application Priority Data

May 12, 1976 [DE] Fed. Rep. of Germany ..... 2621047

[51] Int. Cl.[2] ..... B23P 15/00; E04B 1/35

[52] U.S. Cl. ..... 29/428; 52/745; 254/89 R; 29/429

[58] Field of Search ..... 29/428, 429, 427; 52/745, 747, 63, 83; 254/89 R, 89 H, 93 R; 403/286

[56] References Cited

U.S. PATENT DOCUMENTS

| | | | |
|---|---|---|---|
| 320,683 | 6/1885 | Phillis | 403/286 |
| 821,274 | 5/1906 | Ames | 403/286 |
| 2,686,420 | 8/1954 | Youtz | 254/93 R |
| 2,758,467 | 8/1956 | Brown et al. | 254/93 R |
| 3,036,816 | 5/1962 | Stubbs et al. | 254/89 H |
| 3,201,088 | 8/1965 | Long | 254/89 H |
| 3,299,588 | 1/1967 | Arnold | 52/745 |
| 3,594,965 | 7/1971 | Saether | 52/745 |
| 3,751,783 | 8/1973 | Roberts, Jr. et al. | 29/429 |
| 3,945,106 | 3/1976 | Mayr et al. | 29/428 |

FOREIGN PATENT DOCUMENTS

| | | | |
|---|---|---|---|
| 1165616 | 10/1969 | United Kingdom | 29/429 |
| 1402218 | 8/1975 | United Kingdom | 29/429 |

OTHER PUBLICATIONS

Architectural Forum, "A New Structural Method," Jun. 1950, pp. 135–139.

*Primary Examiner*—C. W. Lanham
*Assistant Examiner*—Daniel C. Crane
*Attorney, Agent, or Firm*—Spencer & Kaye

[57] ABSTRACT

In a method for erecting the jacket of a cable net cooling tower which has a center mast, which method includes hoisting the jacket by lifting forces produced by hoisting means located at the top of the center mast, the jacket is suspended from pulling members composed of groups of threaded steel rod units, each unit being composed of a succession of individual steel rods joined together at their ends by threaded sleeves, the lifting forces are transmitted to the steel rod units by setting elements detachably connected to the steel rods, and the uppermost individual steel rod of each unit is removed when it is no longer in force transmitting relation with the hoisting means.

9 Claims, 11 Drawing Figures

CABLE NET COOLING TOWER JACKET INSTALLATION METHOD

BACKGROUND OF THE INVENTION

The present invention relates to a method and apparatus for mounting the jacket, or casing, of a cable net cooling tower which is suspended from pulling members by hoisting it from the top of a center pole, or mast, which is either completed or still being constructed, by hoisting means.

The use of known cable winches as hoisting means for this purpose entails great difficulties since the winches must be made very heavy due to the high force levels to be exerted and their transport to the top of the pole and subsequent accommodation thereat can only be accomplished at great expense. If known hydraulic jacks are used as the hoisting means and cables, bundles of stranded wires or the like are used as the pulling members, the intermediate anchoring of the cables during the lowering movement of the pressing pistons poses problems and adjustment leads to damage to the cables, thus precluding their reuse.

SUMMARY OF THE INVENTION

It is an object of the present invention to provide a simple and economical method of the above-mentioned type which avoids the above-described drawbacks.

This and other objects are achieved, according to the present invention, by suspending the jacket of the cooling tower from pulling members composed of groups of threaded steel rod units, each unit being composed of a succession of individual steel rods joined together at their ends by threaded sleeves, transmitting the lifting forces to the steel rod units by setting elements detachably connected to the steel rods, and removing the uppermost individual steel rod of each unit when it is no longer in force transmitting relation with the hoisting means.

The significant advantages of the invention are, in particular, that use can be made of the type of threaded steel rods currently employed for the manufacture of reinforced concrete members which are inexpensive and commercially available in large quantities. This is also true for the threaded sleeves employed to connect the individual rods together so that they can be combined into pulling members of any desired length. The rods and the connections between rods have tensile strengths which have been found to be sufficiently high for the purpose involved, and these components have a low weight.

Preferably, according to the invention, the setting elements are nuts which can be advanced along the steel rods and which are arranged to be supported by a perforated plate resting on a supporting base whose height is fixed or adjustable. The nuts are preferably of the undivided, or one-piece, type and one nut is preferably threaded onto each individual rod before the rod units are formed. This arrangement makes it possible, without damage to the pulling members, to effect simple and safe intermediate anchoring practically at any point along the pulling members.

DESCRIPTION OF THE PREFERRED EMBODIMENTS

Figure 1:
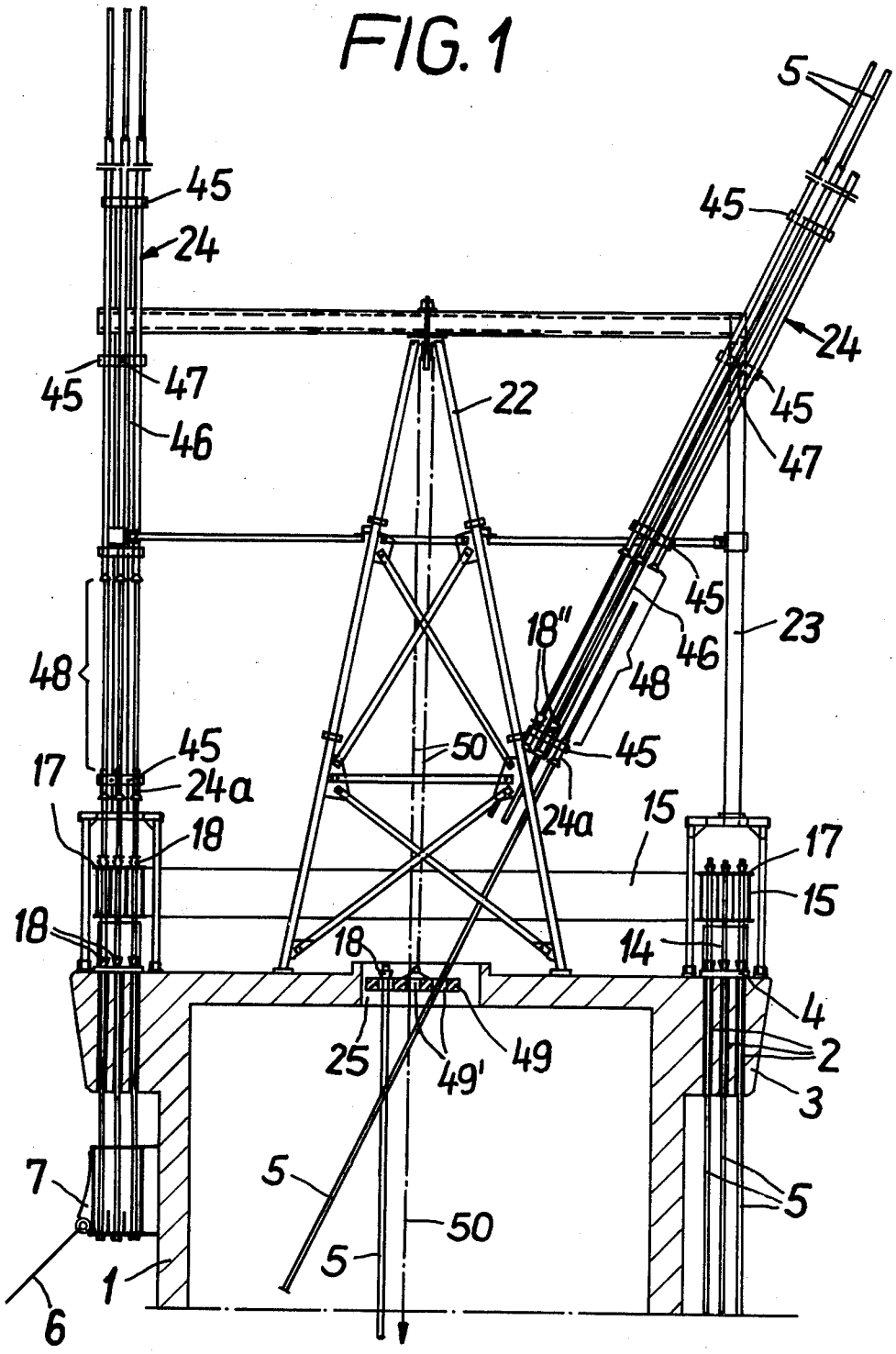
FIG. 1 is an elevational view, partly in cross section, showing the top of the center pole, or mast, of a cooling tower at a point in an installation procedure according to the invention.

As shown, FIG. 1 generally shows the top of the center pole, or mast, 1 of a cooling tower, the top of the mast being provided with a collar 3 having holes 2 which are lined with passage tubes. Perforated plates 4 are disposed horizontally and arranged above holes 2 so that the perforations in these plates are congruent with holes 2. The holes and aligned perforations serve as passages for the threaded steel rods 5 which are here combined into groups of three to serve as pulling members.

Figure 11:
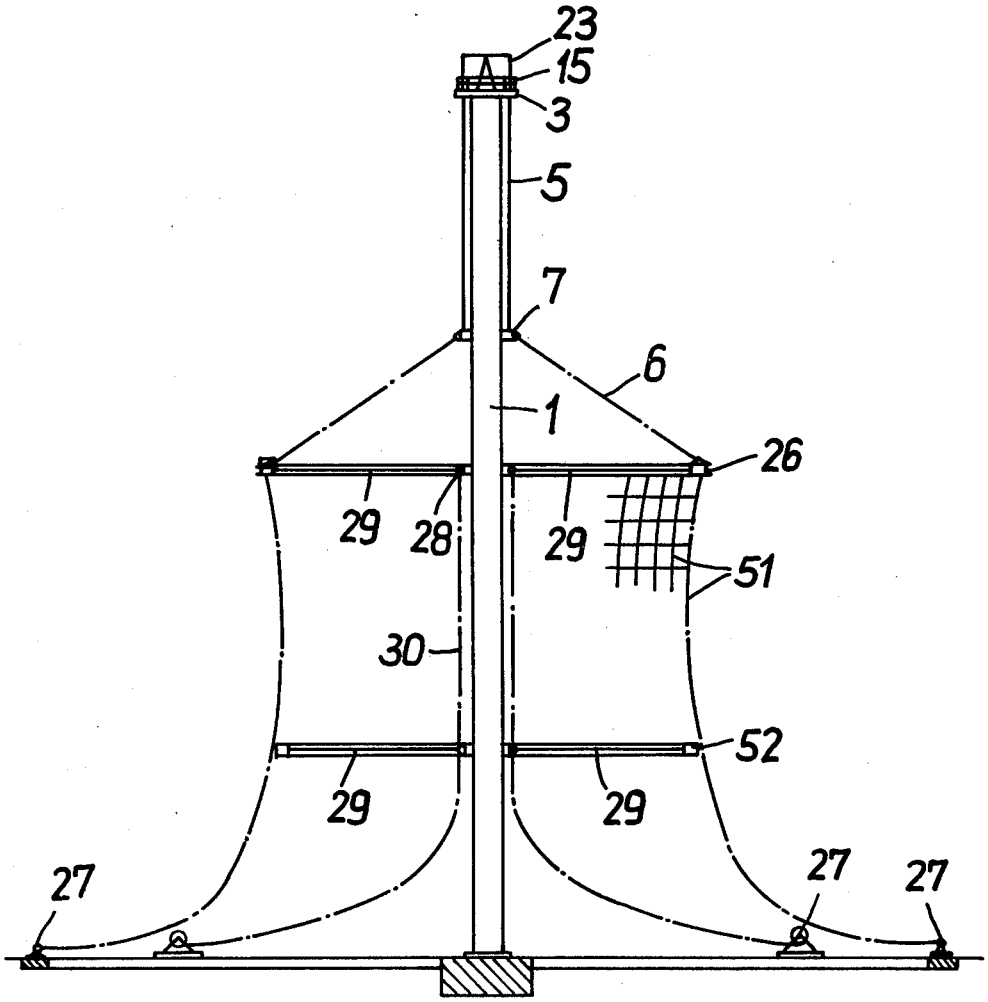
FIG. 11 is an elevational view, partly in cross section, showing the center mast of a cooling tower and its jacket in a hoisting state.

At the lower end of these pulling members a hoisting ring 7 is fastened by means of suspension cables 6 to hold the jacket means of the cooling tower as shown in FIG. 11. An upper distance ring 26 which is suspended by the cables 6 is connected to cable network 51 which forms the jacket of the cooling tower after its erection. An inner ring 28 which is held by spoke cables 29 carries rig cables 30. A further distance ring 52 serves to form an outwardly concave curvature of the jacket. The cables 51 and 30 are withdrawn from reels 27 during the hoisting of the jacket. Cover means such as panels or linings are fitted to the jacket because of the air blast pressure after erection of the tower.

In order to prepare the hoisting ring 7 which extends completely around mast 1, for hoisting, individual rods which have been connected at the foot of the center pole to form pulling members are hoisted up by means of other hoisting members, for example thin ropes or cables, which are lowered from the top of the pole.

Figure 5:
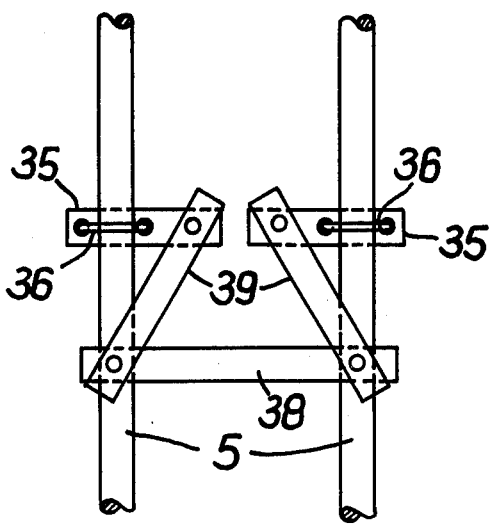
FIGS. 5, 6 and 7 are detail views of three preferred embodiments of connections of groups of rods.
Figure 6:
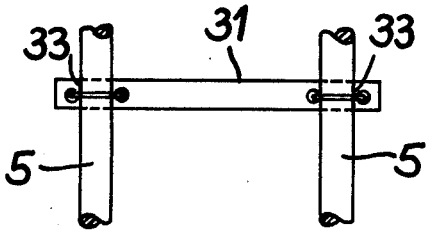
Figure 7:
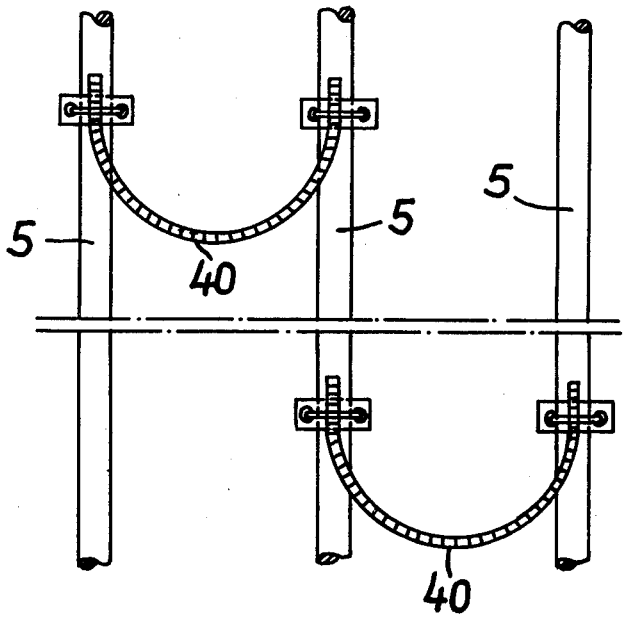

In order to expedite hoisting, the rods are combined into groups, e.g. of three, at this time and the thus combined rods are connected together with sufficient spacing so as to provide damping of vibrations and to permit only slight changes in lateral spacing and longitudinal displacement. FIGS. 5 to 7 show connecting means which are preferably employed for this purpose.

In the simplest case, shown in FIG. 6, each connecting means can be a flat bar 31 which connects two rods 5 and which is fastened to the rods by means of U-bolts 33 which may be of the type constituted by the known cable clamps. In contradistinction thereto the embodiments of FIGS. 5 and 7 permit more freedom of movement which may be important particularly due to the sometimes required longitudinal shifts of rods 5 with respect to one another, for example in order to test or correct the load on an individual pulling member.

The connecting means of FIG. 5 is composed of an individual flat bar 35 and U-bolt 36 secured to each rod 5, together with a linkage formed by a flat cross bar 38 bolted or riveted at each end to a respective rod 5 and link bars 39 each bolted or riveted between a respective end of bar 38 and one end of a respective bar 35. The connections between bars 39 and 35 and 38 permit pivotal movement therebetween.

In the embodiment shown in FIG. 7, the connecting tongues are replaced by wire cables 40 or the like. As is shown in FIG. 7, for groups of three or more pulling members, advisably the pulling members are connected together in pairs and the points of connection are longitudinally offset from one pair to another. This produces better damping of vibrations. This is also true for the embodiments of FIGS. 5 and 6.

Vibrations occur in the pulling members not only when they are in an unstressed state but also under load, the vibrations in the latter case being at different frequencies. The connecting means connecting groups of rods together are therefore installed preferably during hoisting under load. The connecting means simultaneously secure the threaded steel rods 5 against twisting.

Figure 8:
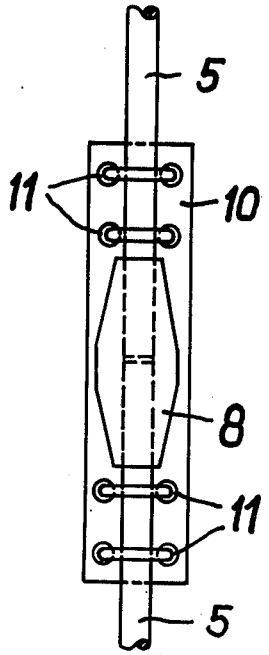
FIGS. 8 and 9 are detail views of two additional mounts disposed at the sleeve connections between successive rods.
Figure 9:
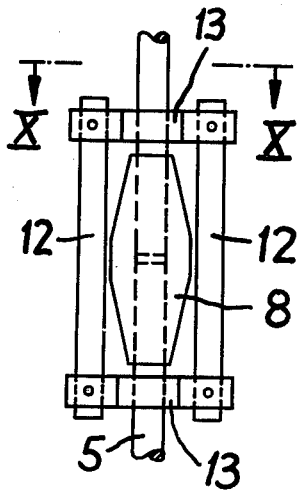
Figure 10:
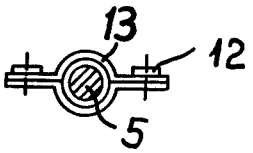
FIG. 10 is a cross-sectional view along the line X—X of FIG. 9.

In FIGS. 8 to 10, two rods which are connected together end-to-end by a threaded sleeve 8 are clamped at points closely adjacent the threaded sleeve by a mount constituting a safety device which prevents possible twisting of the rods, and rotation of the rods out of the threaded sleeve 8 during hoisting of the pulling members without load. Such rotation out is otherwise possible under the effect of high wind stresses when there is a large thread pitch. These mounts are provided particularly when the pulling members are hoisted individually. However, they can also be used in addition to the connections shown in FIGS. 5 through 7.

Figure 8A:
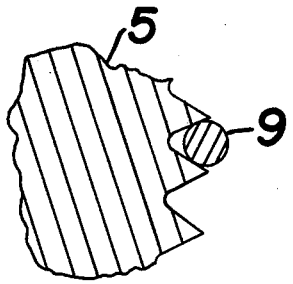
FIG. 8*a* is a cross-sectional detail view of a portion of the mount of FIG. 8.

The mount shown in FIG. 8 is constituted by a shaped shackle plate 10 which extends past the threaded sleeve 8 and which, in addition is provided with four pairs of bores 11 through which there are inserted the two ends of four U-bolts. The U-bolts are arranged preferably at such an inclination to the axis of rods 5 that the arcuate portion lies between two crests of the rod threads, as shown for an exemplary U-bolt 9 in FIG. 8*a*. In the embodiment illustrated in FIGS. 9 and 10 the mount is composed of two two-part tube shells 13, comparable to tube or pipe clamps, connected to one another by two tension rods 12, to which they are bolted. While a certain spacing is shown in FIG. 10 between shells 13 and rod 5, the shells in fact tightly grip the rod.

During the subsequent hoisting under load, the connecting means between laterally adjacent rods and/or the mounts of FIGS. 8–10, but not, of course, sleeves 8, are removed before holes 2 are reached. This process, as well as initial threading of the pulling members up into the hoisting mechanism, is effected from a working platform (not shown) disposed below collar 3, which had been required previously for fabrication of the collar.

Figure 2:
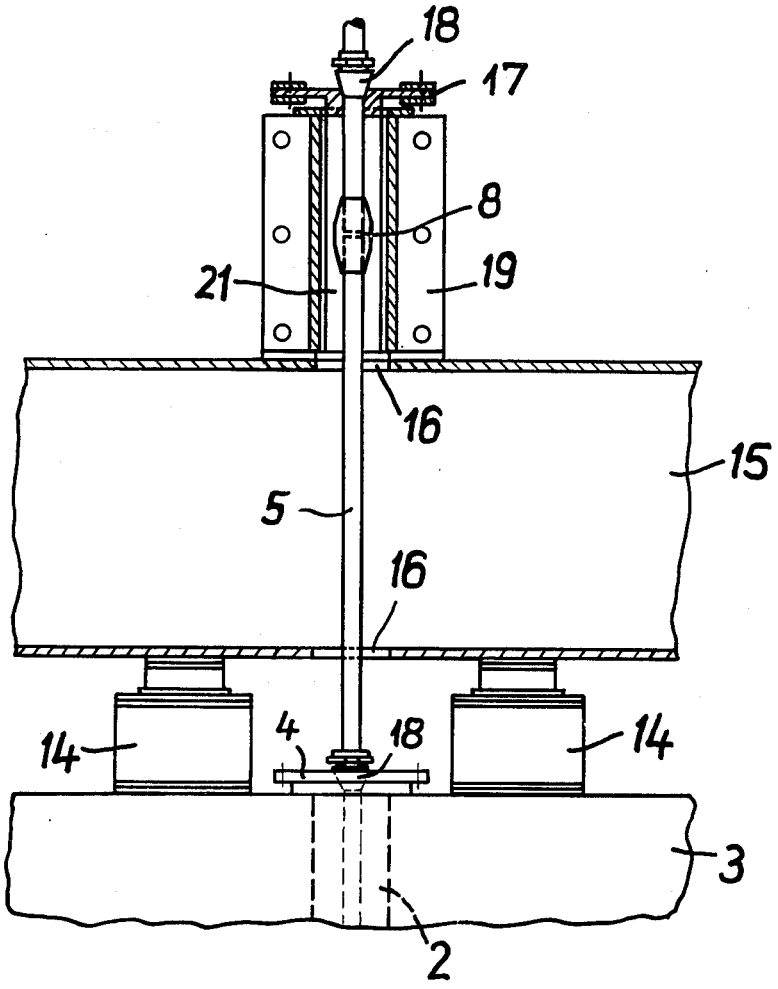
FIG. 2 is a side elevational cross-sectional detail view of a hoisting ring with a supporting block set thereon in the structure of FIG. 1, the scale of FIG. 2 being larger than that of FIG. 1.

Reverting to FIGS. 1 and 2, the actual hoisting process is effected by hydraulic power cylinders, or jacks, 14 which move a press hoist ring 15 up and down. The press hoist ring 15 is provided with passages 16 which are disposed exactly above holes 2. A perforated plate 17 for each rod group is mounted above ring 15 and is provided with bores aligned with passages 16. Plate 17 supports nuts 18 which are threaded onto rods 5 and carry the lifting load during each hoisting movement. The same number of nuts 18 is disposed below press hoist ring 15, the latter nuts being supported by a perforated plate 4. The nuts 18 associated with plate 4 are rotated to move downwardly, during the hoisting process, after each upward movement of ring 15 and take over the load during the downward movement of the press hoist ring 15.

Each perforated plate can rest directly on press hoist ring 15, as shown in FIG. 1, or it can be supported by ring 15 through the intermediary of a supporting block 19, as shown in FIG. 2. The supporting block 19 is employed if, when ring 15 is in its lowermost position, a sleeve 8 or nut 18 would interfere with plate 17 were it to rest directly on ring 15, or if the nut 18 associated with the individual rod 5 then extending through and projecting above ring 15 is presently engaging the underlying plate 4 and is therefore unavailable for use with plate 17. The latter situation is depicted in FIG. 2.

Whenever block 19 is to be removed and plate 17 is to be returned to its rest position directly on ring 15, provision must be made for the fact that the diameter of each bore in plate 17 is smaller than the outer diameter of nuts 18 and, normally, the outer diameter of sleeves 8. This could be accomplished by unscrewing the rod which then extends through plate 17 from the sleeve 8 connected to its lower end, withdrawing that rod upwardly through plate 17, then unscrewing that sleeve 8 from the underlying rod, removing support 19, slipping plate 17 over the exposed end of the remaining rod and down into engagement on ring 15, and screwing a nut 18 onto the upper end of the remaining rod and tightening it against plate 17. Alternatively, plate 17 can be subdivided along the diameter of each of its nut-engaging bores 18', as shown in FIGS. 3 and 4, so that the parts of plate 17 can be separated and then reassembled around rods 5 after support 19 has been removed.

When press hoist ring 15 undergoes a lifting movement, perforated plates 17 rest directly on the ring, as shown in FIG. 1. Then, if during the subsequent downward movement of ring 15, one or several sleeves 8 of a group of rods pass above this location of a plate 17, these rods then being supported by plate 4, plate 17 will be lifted up by these sleeves and a supporting block 19, as shown in FIG. 2, is placed onto press hoist ring 15 at the location of each such rod and the perforated plate 17 is then positioned on supporting block 19. The associated nut 18 is then tightened down against plate 17 so that the load is transferred to the press hoist ring 15 through the perforated plate 17 and supporting block 19 on which plate 17 is supported. The supporting block 19 is anchored to its associated support and is designed so that it can be inserted around a rod or group of rods from the side, i.e. it can be open at the side facing forward in FIG. 2. Its height is greater than the combined length of a threaded sleeve 8 and a nut 18. The vertical passage 21 of supporting block 19 has at least the same inner diameter as the recesses 16 in the press hoist ring 15.

The use of supporting blocks 19 makes it possible for all pulling members to remain continuously under load so that their full supporting power can be utilized. If at least perforated plates 4 are subdivided as shown in FIGS. 3 and 4, along diameters of their nut-engaging bores 18', the parts of such plate can be separated to permit passage of nuts 18 and sleeves 8 and installation is facilitated since undivided nuts 18 can be used, which affords greater safety. An undivided nut is advisably screwed onto each individual rod before the rods are assembled and are disposed directly below the threaded sleeves 8 or the associated mounts 10, 11 or 12, 13. When nuts are used which are divided, in a known manner, prior screwing on is unnecessary.

Figure 3:
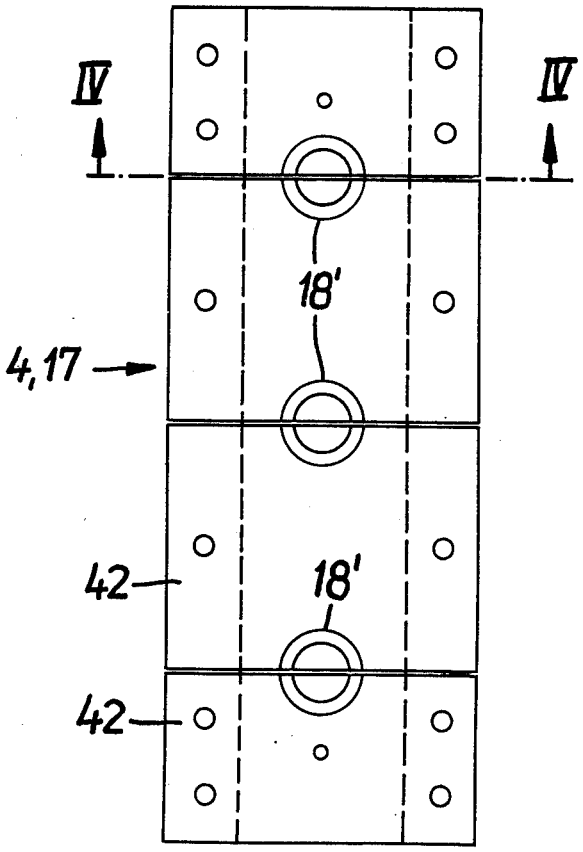
FIG. 3 is a top plan view of a group of subdivided perforated plates which can be employed in the structure of FIGS. 1 and 2, the scale of FIG. 3 being larger than that of FIG. 2.
Figure 4:
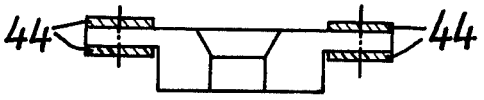
FIG. 4 is a cross-sectional view along the line IV—IV of FIG. 3.

In the embodiment shown in FIGS. 3 and 4, a perforated plate 4 or 17 for a group of rods is composed of a plurality of plate sections 42 detachably connected together by flat connecting bars 44 extending the length of the assembled plate and fastened to each plate section 42, for example by bolts. Bars 44 are not shown in FIG. 3 for the sake of clarity, but their position is indicated by broken lines.

The threaded sleeves 8 of at least one group of pulling members are arranged in horizontal alignment if possible in order to keep use of supporting blocks 19 to a minimum. Alternatively, supporting blocks 19 can also be arranged underneath press hoist ring 15, directly on collar 3, if the spacing between the ring and collar is set accordingly, or if the press hoist ring is designed to permit this, e.g. is provided with recesses. The supporting blocks 19 are used in this case whenever the threaded sleeves 8 pass the initial location of a lower perforated plate 4 during a lifting movement. Use of supporting blocks both directly on collar 3 and on press hoist ring 15 is necessary if the length of a lifting stroke of ring 15 is less than the combined length of a threaded sleeve 8 and a nut 18.

As shown in FIG. 1, a framework 23 is connected with a tripod 22 fastened to the top of mast 1 and groups of three pipes 24, resembling a quiver, are pivotally fastened to this frame 23 by a bolt 47, which is fastened to a girder 46. The girder 46 carries cross holders 45 connected to the pipes 24. For better manipulation, the pipes of these groups of pipes 24 are recessed in their lower region at 48 so that there are formed lower groups of pipes **24*a***.

The pipes of a group 24 receive, when the group is in the position shown at the left-hand side of FIG. 1, the upwardly protruding rods 5 so as to simultaneously secure them against bending until the threaded sleeve 8 of the current uppermost connecting point between rods of the pulling member has reached a sufficient height to permit this connection to be disassembled. The rod or the three unscrewed rods of a group, respectively, are then fixed in respective pipes and the group of pipes 24 is pivoted so that the individual rods can be lowered through an opening 25 in the top of the mast 1. Then the group of pipes 24 is again returned to its starting position to receive the next following individual rods 5.

The groups of pipes 24 and the associated assembly members may also function in the inverse sequence: in this way the pulling members can be assembled at the top of the pole and can be lowered from there. This eliminates cable winches, in particular. Lowering can also be effected under load from any desired position if this should become necessary for some reason.

The number of pulling members uniformly distributed around the circumference of the top of the mast 1 depends, of course, on the respective maximum load and the permissible stress on the individual rods. Correspondingly, the same applies for the number or size, respectively, of the lifting jacks 14 employed. The use of a press hoist ring simplifies and additionally secures assembly.

If during the hoisting process those nuts 18 which are currently unstressed are caused to follow, i.e. are screwed downwardly so that they take over the load during a possible malfunction, i.e. failure of a jack, this results in an additional further safety feature during assembly which otherwise would be made possible only with the use of known, so-called setting ring jacks, which could involve significantly greater expenditures.

Almost all of the individual parts to be used in the practice of the present invention, including the threaded steel rods, threaded sleeves, nuts, mounts, and rod connections, can be reused economically after installation.

Divided nuts 18″ also serve for securing the rods 5 against lowering when the group of three pipes 24 is pivoted as shown at the right-hand side of FIG. 1. The nuts 18″ are supported by the pipes **24*a*. Instead of the nuts 18″ the flat bars 31 may be used for the same purpose. After removal of a nut 18″ from one of the rods 5 this rod is lowered and thereby taken up by a perforated plate 49 which has several holes 49′. The plate 49 may be lowered by a whinch cable 50 when the holes 49′ are filled in with rods 5. The rods are supported by the plate 49 by undivided nuts 18** which are screwed on at the top of each rod.

It will be understood that the above description of the present invention is susceptible to various modifications, changes and adaptations, and the same are intended to be comprehended within the meaning and range of equivalents of the appended claims.

What is claimed is:

1. In a method for erecting the jacket of a cable net cooling tower which has a center mast, which method includes hoisting the jacket by lifting forces produced by hoisting means located at the top of the center mast, the improvement comprising: suspending the jacket from pulling members composed of threaded steel rod units, each unit being composed of a succession of individual steel rods joined together at their ends by threaded sleeves, the individual steel rods including setting elements comprising nuts in movable threaded engagement with the steel rods; supporting during the suspending step the nuts on a perforated plate mounted on a supporting base; transmitting the lifting forces to the steel rod units by the setting elements detachably connected to the steel rods;

interposing a supporting block having an effective height at least equal to the combined length of a threaded sleeve and a nut between the perforated plate and the supporting base whenever a threaded sleeve moves into the space that would be occupied by the perforated plate when resting directly on the supporting base; and removing the uppermost individual steel rod of each unit when it is no longer in force transmitting relation with the hoisting means; and wherein the hoisting means are constituted by lifting jacks.

2. Method as defined in claim 1 wherein the nuts are undivided nuts and one such nut is screwed onto each individual rod before the latter are assembled into pulling members.

3. Method as defined in claim 2 wherein the steel rod units are combined into groups.

4. Method as defined in claim 3 wherein each group includes the same number of steel rod units.

5. Method as defined in claim 3 further comprising connecting the pulling rod units of a group together, while the group is below the top of the center mast, with sufficient spacing to permit slight changes in spacing and longitudinal displacement between units.

6. Method as defined in claim 1 wherein said step of removing comprises introducing the uppermost individual rod of a unit, when no longer under load into a respective hollow pipe while the pipe is in an initial position, unscrewing the uppermost rod from the associated uppermost threaded sleeve when that sleeve has reached a sufficient height, then securing that uppermost rod in the pipe, moving the pipe into a discharge position, subsequently releasing the rod from the pipe and lowering the rod, and returning the pipe to its initial position.

7. Method as defined in claim 1 further comprising clamping together the adjacent ends of successive individual rods by a mount disposed at the associated threaded sleeve.

8. Method as defined in claim 7 wherein said step of clamping is carried out in a manner to apply a clamping force from at least one side between adjacent crests of the threads of each individual rod.

9. A method as defined in claim 1 wherein the perforated plate serves to at least temporarily support a pulling member and is divided into separable sections at the location where it contacts a nut.

* * * * *